United States Patent [19]

Corgnet

[11] 4,066,031

[45] Jan. 3, 1978

[54] DEVICE FOR REGULATION OF ANCHORAGE FORCES

[75] Inventor: Jean Louis Corgnet, Boulogne, France

[73] Assignee: Compagnie Francaise des Petroles, Paris Cedex, France

[21] Appl. No.: 721,929

[22] Filed: Sept. 9, 1976

[30] Foreign Application Priority Data

Sept. 26, 1975 France ..... 75.29523

[51] Int. Cl.[2] ..... E02B 17/00

[52] U.S. Cl. ..... 114/294; 61/86; 61/95

[58] Field of Search ..... 61/86, 112, 94, 95; 114/54, 230, 16 E, 294, 295, 207, 211; 9/8 P; 141/387, 388, 279

[56] References Cited

U.S. PATENT DOCUMENTS

| | | | |
|---|---|---|---|
| B 484,769 | 3/1976 | Flory | 114/230 |
| 2,922,446 | 1/1960 | Sheiry | 141/388 |
| 3,008,158 | 11/1961 | Stinson | 114/230 UX |
| 3,217,748 | 11/1965 | Harper | 141/388 X |
| 3,455,270 | 7/1969 | Mascenik et al. | 9/8 P X |
| 3,535,883 | 10/1970 | Manning | 141/387 X |

FOREIGN PATENT DOCUMENTS

| | | | |
|---|---|---|---|
| 2,255,857 | 6/1973 | Germany | 141/388 |

*Primary Examiner*—Dennis L. Taylor
*Attorney, Agent, or Firm*—Sughrue, Rothwell, Mion, Zinn and Macpeak

[57] ABSTRACT

An anchor arm for anchoring a floating body, e.g. a semi-submersible platform, to a fixed anchor point pivotable about a vertical axis, comprises upper and lower articulated arms articulated to the floating body and anchor point respectively and a device for regulating forces transmitted to the arm comprising an articulated coupling connected across the articulation of the arm parts which is acted on by a float.

5 Claims, 7 Drawing Figures

DEVICE FOR REGULATION OF ANCHORAGE FORCES

The invention concerns an anchor arm including a device for regulating the transmission of forces between a floating surface body anchored by the arm, e.g. a semi-submersible platform, and the anchorage point.

There are already in existence rigid anchor arms for coupling a surface support to an anchorage point, provided at their ends with articulations and possibly shock absorbing devices so as to avoid the transmission of sudden forces due to the movements to which the surface support is subjected. When these anchor arms are used with platforms of very high mass, especially semi-submersible platforms for the exploitation of oil fields, located in areas congested with drifting ice, the anchor arms are reinforced with struts to avoid buckling.

These arms have the advantage of maintaining a constant distance between the platform and the anchor point without subjecting the articulations to fatique, the inclination of the arm remaining practically constant. But as soon as the surface support is subjected to any pounding caused by the swell and the arm extends at a relatively small angle to the vertical, the arm is subjected to very large tension and compression forces. On the other hand, when the arm is at a relatively small angle to the horizontal, the longitudinal forces to which it is subjected due to even slight movements of the platform cannot be absorbed by adequate displacement of the shock absorbers. Thus the anchor arm can only work without abnormal fatigue over a very small range of angular positions.

To remedy these disadvantages, use is made of an arm in two parts linked by an auxiliary central articulation which permits practically any longitudinal or pounding motion of the platform, whatever the inclinations of the two parts of the arm. The flexibility of an anchorage formed in this way leads to frequent movements of the platform, however, resulting in premature wear of the articulations. This wear is further accentuated by the inertial effects which are produced, especially when the platform is surrounded with ice. The forces exerted on the platform by the ice are not of a sinusoidal nature, as is the case with the swell, but in the form of irregular sawteeth, the forces increasing more or less linearly with the movement of the ice against the platform until a break forms in the sheet of ice, causing a sudden drop in the force, until the ice contacts the platform again. These sudden changes in the force exerted on the platform by the ice can cause serious vibration of the anchor system.

Furthermore, the need to be able to free the anchorage in the presence of icebergs, and the consequent need for a recovery buoy attached to the part of the arm between the anchor point and the central articulation, involves the risk of serious damage to the arm when, after freeing the anchorage, the lower end of the arm breaks the surface of the ice filled water.

It is an object of the present invention to provide an anchor arm for anchoring a floating surface body to a submerged anchor point pivotable about a vertical axis, comprising upper and lower anchor arm parts articulated together and to the anchor point and surface body, and a device for regulating the force transmitted to the anchor arm, including at least one articulated coupling continuously acted on by a float and connected to said upper and lower arm parts to either side of their articulation. The arrangement is such that any push or pull exerted on the surface body produces a corresponding reaction from the coupling.

Thus not only is such an anchor arm no longer subjected to forces due to pounding of the surface support, whatever the inclination of the imaginary line joining the attachment point of the arm to the surface body to the anchor point, but the articulations of the arm to its anchor point and the surface body are also no longer subjected to premature wear or excessive fatigue, all longitudinal movements of the platform being immediately damped and maintained within limits which are considerably reduced as compared with the virtually free run of the known system with articulated arms.

All the disadvantages of the known systems are thus avoided, while keeping their advantages: flexibility of the anchor arm, maintenance of a virtually constant distance between the anchor point and the surface body. Also, the flexibility of the reactions of the coupling due to the float enables the risk of serious vibration to be avoided, even when there is a lot of ice.

The float preferably has a sufficiently small buoyancy that, in the event of freeing the anchor arm, the whole has only a slight positive buoyancy, this reduction in buoyancy being compensated by a demultiplier connection between the float and the articulated coupling.

Thus, even if the arm is freed from its anchor point, the assembly will not strike the ice with force, so that risk of damaging the system is substantially reduced while the disadvantages of the known systems are avoided.

The regulating device is advantageously capable of being locked to render the coupling between the two arm parts rigid.

It is thus possible to arrange the anchor arm in a convenient position after it is raised to the surface and locked, and even to use it in this position if the sea is unfavourable and there is a risk of ice causing dangerous vibration.

The regulation device can be mounted on or adapted to any anchor arm which has two parts and satisfies all conditions of use, without its satisfactory operation being at any time impeded by the disadvantages of the known systems, or wear of the articulations being thereby accelerated.

The invention will be more fully understood from the following description of an embodiment thereof given by way of example only, with reference to the accompanying drawings.

Figure 1:
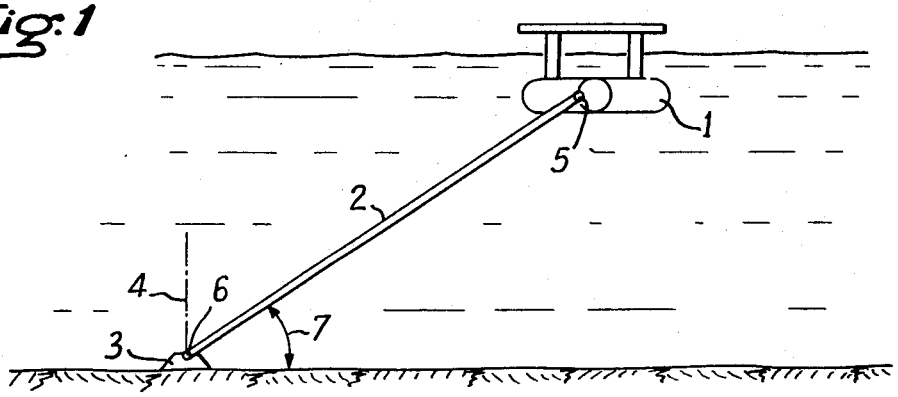
FIG. 1 shows diagrammatically a known rigid anchor arm.

A known anchor device for a platform, especially a semi-submersible platform, is shown in FIG. 1, and comprises a rigid arm 2 and an anchor point 3 pivotable around a vertical axis 4, the arm 2 being pivotable about horizontal articulations 5 and 6 on the platform and anchor point. These devices withstand the pounding of the platform without serious disturbance when the angle 7 between the arm and the sea bed is small, and similarly withstand longitudinal movement of the platform when the angle 7 is close to 90°. In all other cases the arm 2 can be subjected to large forces in spite of shock absorbing devices which are generally fitted in the vicinity of the articulation 5, the angle 7 remaining constant during possible movements of the platform 1.

Figure 2:
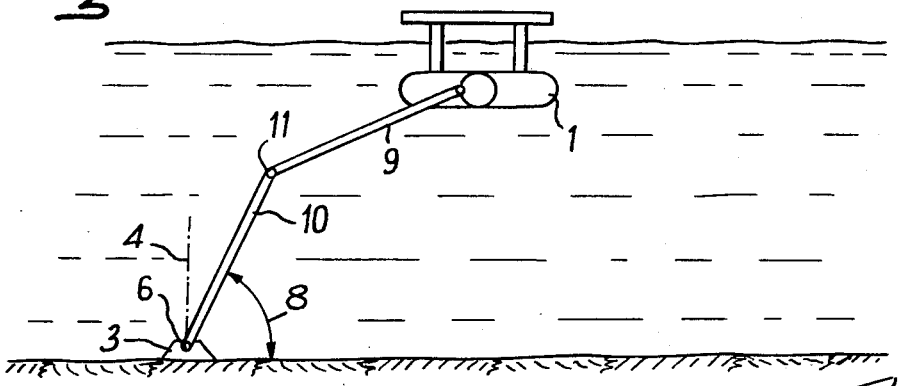
FIG. 2 shows diagrammatically a known anchor arm having a central articulation.

Anchor devices of the type shown in FIG. 2 have, instead of a rigid arm 2, an arm formed in two parts, an upper part 9 and a lower part 10, connected by an intermediate articulation 11. As the angle 8 is variable, the platform can move without exerting high loads on the arms 9 and 10, but the articulation 6 is subject to stress virtually all the time, causing serious premature wear.

Figure 3:
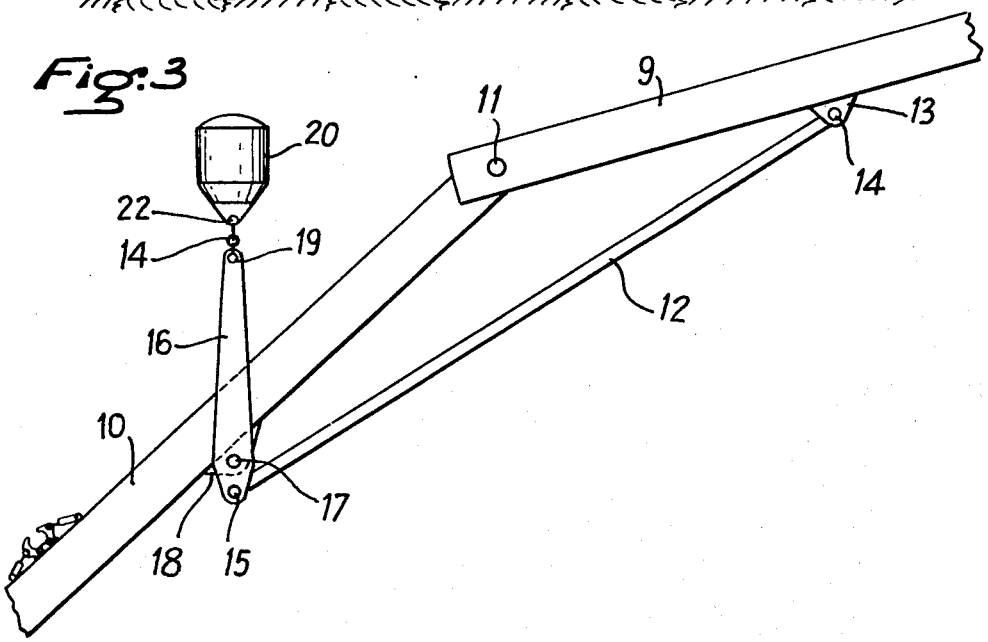
FIG. 3 is a side view of part of an embodiment of an anchor arm according to the present invention.

An anchor arm which overcomes these various disadvantages is shown in FIG. 3 and comprises upper and lower articulated arm parts 9 and 10 and a device comprising a coupling formed by an arm 12 articulated at 14 to brackets 13 fixed to the upper arm part 9 and at 15 to a lever 16 itself articulated at 17 to a bracket 18 on the lower arm part 10. Thus to any force exerted on the arm parts 9 and 10 there corresponds a force exerted on the coupling 12, 16 extending between the articulations 14 and 17.

Figure 6:
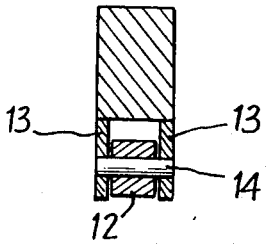
FIG. 6 is a sectioned view of the articulation of the articulated coupling to the upper anchor arm part.

The articulation 14, shown in FIG. 6, may consist of a simple pivot pin 14 mounted in brackets 13 and passing through the coupling arm 12. This arm is subjected to compression loads, and so may be of a tapered form to resist buckling.

Figure 4:
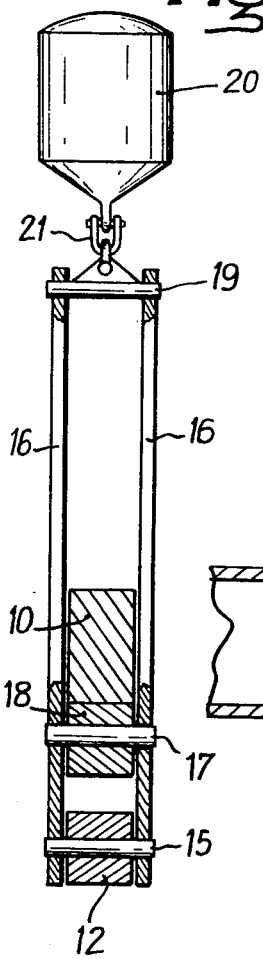
FIG. 4 is a partially sectioned view of the float and its attachment to the lever.

The articulation 17, shown in FIG. 4, may consist of a pivot pin 17 mounted on a pair of levers 16 arranged one on each side of the lower arm part 10. Likewise, as shown, the articulation 15 is formed by a pivot pin 15 mounted on the lower ends of the levers 16 and passing through the coupling arm 12.

Figure 7:
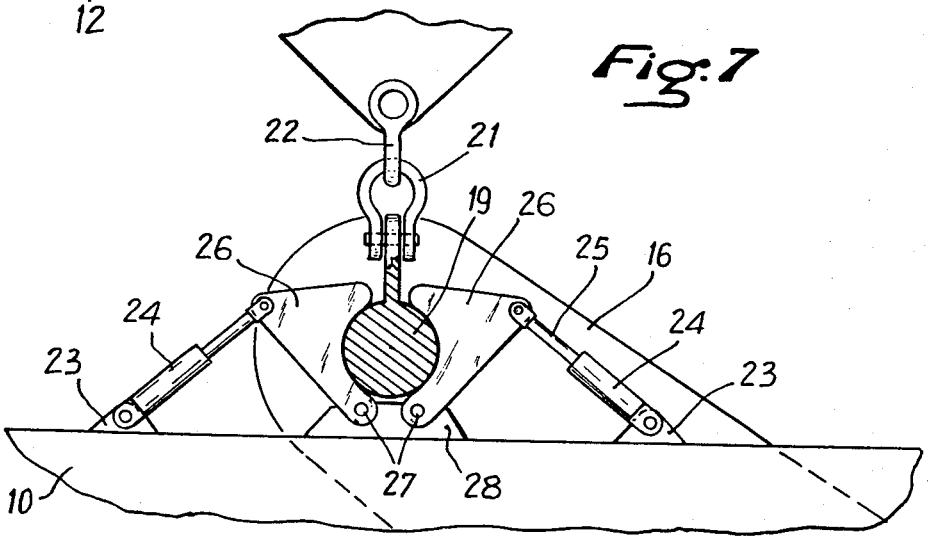
FIG. 7 shows schematically a device for locking the achor arm of FIG. 3.

The levers 16 are connected at their upper ends by a shaft 19 acting as a stirrup, to which a float 20 is attached by means of links 21 and 22 seen more clearly in FIG. 7.

As shown in FIG. 7, brackets 23 are fixed to the lower arm part 10 and on which are articulated cylinders 24, the piston rods 25 of which control the angular movement of locking members 26 around pivot pins 27 in a bracket 28 fixed to arm part 10.

When the piston rods 25 of the cylinders 24 are advanced, as shown, the members 26 approach one another and ring the pin 19 when the lower arm part 10 is aligned with the arm part 9, the levers 16 then being in the position shown in FIG. 7. When the cylinders 24 are operated to retract the piston rods 25 as shown in FIG. 3, the members 26 are moved apart, and the device can be deformed in accordance with the forces present.

It will be clear that the various components of the device, including the float, can be of any shape, and that any number of cylinders 24 and locking members 26 can be used.

Figure 5:
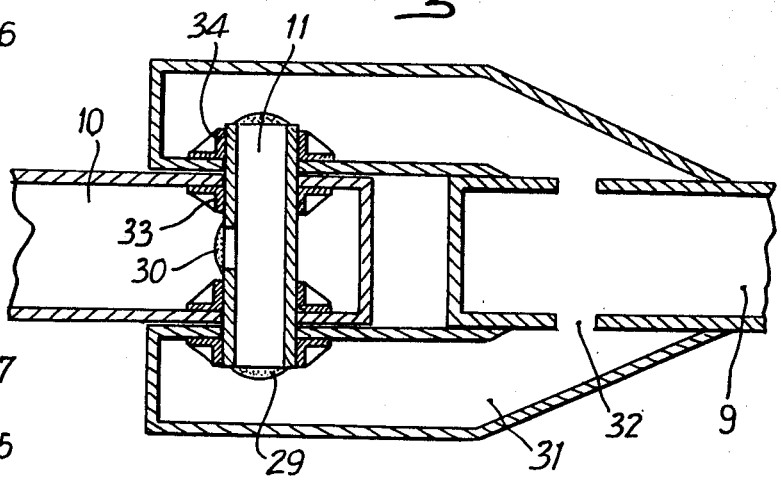
FIG. 5 is a sectioned view of an articulation of the arm parts incorporating a passage leading to the anchor point.

In particular, when the anchor arm must allow for the passage of personnel, the articulation of the arm parts 9 and 10 can be as shown in FIG. 5, in which the pivot pin of the articulation 11 comprises an internal passage providing communication between hatches 29 and 30 mounted on the pin, the hatch 29 leading into a housing 31 fastened to the arm part 9 and communicating through the opening 32 with a passage formed in the arm part 9. Likewise the hatch 30 leads to a passage in the arm part 10. The supports 33 and 34 of the pin 11 may be of any desired type. As for the cylinders 24, the means for controlling them have not been shown as they can be of any type.

A convenient regulation device is obtained in this way, since in the operational condition, i.e. when the arm part 10 is anchored at its lower end and the bolts 26 are spaced to free the levers 16, the float exerts an action on the coupling 12 such that any force on the platform tending to move it closer to or further away from its anchor point causes the lever 16 to swing to oppose such movement. Furthermore, the lever arm defined between the articulation 17 and the axis 19 is selected to be sufficiently long in relation to the lever arm defined by the articulations 15 and 17 to considerably reduce angular movement of the arms 9 and 10 and practically eliminate movement of the platform 1, as in the case of a rigid arm, but without any of the inherent disadvantages of a rigid system. In the presence of ice likely to cause troublesome vibration, it is sufficient to lock the device to maintain the arm rigid and avoid such disadvantages. Finally, the demultiplication obtained by virtue of the significant difference in length of the lever arms defined by the position of the articulation 17 of the levers 16 permits the use of floats having just sufficient buoyancy to prevent the arm parts 9 and 10 rising too quickly to the surface.

It goes without saying that numerous modifications can be made to the device described without departing from the scope of the invention, since equivalent forms can be used for each of the articulated coupling of the arm parts 9 and 10 articulated at 11, and the connection of the float to this articulated coupling. In particular, the linking of the articulations 15 and 17 could be independent of the lever 16 and depend on an arm to which a coupling attached to the float 20 could be articulated, the lever 16, for example, which would not be articulated at 15 or 17.

In particular, the articulation point 17 could divide the lever 16 into lever arms with lengths in a ratio between 1.5 and 20, the lever 16 being vertical in the absence of movement of the platform 1.

What is claimed is:

1. An anchor arm for anchoring a floating body to a submerged anchor point comprising anchor means adapted to be secured at the bottom of a body of water for pivotal movement about a vertical axis, upper and lower anchor arm parts articulated to each other and to said floating body and said anchor means respectively and force regulating means for regulating the forces transmitted to the anchor arm by said floating body including articulated coupling means connected to said upper and lower arm parts on opposite sides of their articulation and float means connected to said articulated coupling means to impart a force to said anchor arm parts opposite to the forces transmitted by said floating body to said upper and lower arm parts.

2. An anchor arm as set forth in claim 1 wherein said articulated coupling means is comprised of a rigid arm pivoted at one end to said upper arm part and a lever pivoted intermediate the ends thereof to said lower arm part and pivotally connected at one end to the other end of said rigid arm and pivotally connected at the other end to said float means whereby said float means will tend to pivot said lever to a vertically disposed position in the absence of any forces being imparted to said arm parts by said floating body.

3. An anchor arm as set forth in claim 2 wherein said lever is comprised of a first lever arm to which said float means is connected and a second lever arm to which said rigid arm is connected with the ratio of the length of said first lever arm to the length of the second lever arm being between 1.5 and 20.

4. An anchor arm as set forth in claim 1 further comprising locking means for locking said upper and lower anchor arm parts together to form a rigid anchor arm.

5. An anchor arm as set forth in claim 2 further comprising locking means mounted on said lower arm part for locking said lever to said lower arm part so that said upper and lower arm parts will define a rigid anchor arm.

* * * * *